United States Patent [19]

Marshall et al.

[11] 4,271,674

[45] Jun. 9, 1981

[54] PREMIX COMBUSTOR ASSEMBLY

[75] Inventors: Richard L. Marshall, Manchester, Conn.; Kenneth A. Cashman, Scarborough, Me.

[73] Assignee: United Technologies Corporation, Hartford, Conn.

[21] Appl. No.: 712,575

[22] Filed: Aug. 9, 1976

Related U.S. Application Data

[63] Continuation of Ser. No. 515,750, Oct. 17, 1974, abandoned.

[51] Int. Cl.[3] ..... F23R 3/42

[52] U.S. Cl. ..... 60/737; 60/746; 60/749

[58] Field of Search ..... 60/39.65, 39.74, 39.72, 60/737, 746, 749

[56] References Cited

U.S. PATENT DOCUMENTS

| | | | |
|---|---|---|---|
| 2,635,426 | 4/1953 | Meschino | 60/39.65 |
| 2,679,137 | 5/1954 | Probert | 60/39.65 |
| 3,055,179 | 9/1962 | Lefebvre et al. | 60/39.65 |
| 3,290,880 | 12/1966 | Poyser | 60/39.65 |
| 3,820,324 | 6/1974 | Grindley et al. | 60/39.65 |

*Primary Examiner*—Stephen C. Bentley
*Attorney, Agent, or Firm*—Normal Friedland

[57] ABSTRACT

A combustor assembly having improved performance at low engine power operation and at altitude relight includes an annular combustion chamber, two fuel sources, and a premixing passageway having an outlet positioned adjacent either the inner and outer annular well of the combustion chamber. A perforated baffle is disposed across the outlet of the premixing passageway, the outlet being in gas communication with the combustion zone. In a preferred embodiment, for low power operation, such as for idle or for altitude relight, fuel from a first source is sprayed directly into the combustion zone. During this low power operation a localized stagnation region is created adjacent the fuel source which acts as a continuous ignition source for the combusting fuel-air mixture within the combustion zone. For high power operation such as takeoff, climb and cruise, fuel from a second source is injected into the premixing passageway where it is atomized by air entering the passageway from the compressor. During this high power operation the fuel-air mixture within the premixing passageway is directed into the combustion zone through the perforated baffle and radially across the combustion zone toward the opposite wall of the combustion chamber; the perforated baffle creates a localized stagnation region adjacent its surface which acts as a continuous ignition source for the combusting fuel-air mixture within the combustion zone during high power operation.

12 Claims, 4 Drawing Figures

PREMIX COMBUSTOR ASSEMBLY

CROSS REFERENCE TO RELATED APPLICATIONS

This application is a continuation of application Ser. No. 515,750, now abandoned which was filed on Oct. 17, 1974 and assigned to United Technologies Corporation.

BACKGROUND OF THE INVENTION

1. Field of the Invention

This invention relates to combustion chambers for gas turbine engines.

2. Description of the Prior Art

The emphasis today on the design and development of gas turbine engines for jet aircraft is towards pollution control, high temperature operation and reduction in engine weight without thrust penalties. Much of this design and development work is centered on the combustor section of the engine which, conventionally, has not provided the clean burning which is now desired. Furthermore, conventional combustors require a considerable axial length to perform the burning process; this increases the overall engine length, which of course results in an increase in engine weight.

Premixing of the fuel with the air is one technique which has been investigated to improve the combustion process. U.S. Pat. No. 2,999,359 to F. R. Murray shows such a technique in FIG. 2. One purpose of all the constructions shown in Murray is to create recirculating counter-rotating zones of combusting fuel and air within a primary combustion zone to improve combustion efficiency. Such recirculation increases the length of time the combusting fuel and air remains in the primary zone of combustion; this is undesirable from a pollution viewpoint since it increases the amounts of oxides of nitrogen produced within the combustion chamber.

Another fuel-air premixing system is shown in U.S. Pat. No. 3,055,179 to Lefebvre et al. In Lefebvre a stream of premixed fuel and air is injected into a secondary combustion zone through a plurality of auxiliary chutes, the mixture being ignited in the combustion zone by a pilot flame. The pilot flame extends from a toroidal pilot combustion chamber which encourages the recirculation of combustion gases within the toroidal zone. Again, as in Murray this recirculation increases the length of time the combusting fuel and air remains within high temperature regions and correspondingly increases the amounts of oxides of nitrogen produced within the combustion chamber.

A premix type of combustor system which has solved many of the above problems is described in copending patent application Ser. No. 336,578, PREMIX COMBUSTOR ASSEMBLY by J. E. Faucher, W. D. Roy and R. W. Koucky, filed on even date with the parent application from which the present application derives and having the same assignee as the present application.

Continuing efforts are being directed to the design of combustion chambers which are capable of fully combusting fuel within a limited axial length while minimizing the recirculation of combusting gases through high temperature zones which are capable of producing oxides of nitrogen. Additionally, these chambers must maintain flame stability during all engine operating conditions and have sufficiently high chamber exit temperatures to reduce unburned hydrocarbon emissions.

SUMMARY OF THE INVENTION

An object of the present invention is an improved combustor assembly for gas turbine engines, and more particularly a premix annular combustion chamber having improved pollution characteristics and improved flame stability at low power settings. Sufficiently high combustor exit temperatures must be maintained to reduce unburned hydrocarbon emissions while reducing recirculation to minimize the production of oxides of nitrogen.

Accordingly, the present invention is a combustor assembly including an annular combustion chamber, a premixing passageway having an outlet positioned adjacent either the inner or outer wall of the combustion chamber, a baffle disposed across the outlet of the passageway, first fuel supply means for injecting fuel into the passageway, and second fuel supply means for injecting fuel into the combustion zone, the baffle having openings therein for directing a fuel-air mixture from the passageway into the combustion chamber and radially across the combustion zone toward the opposite wall of the combustion chamber. The first fuel supply means is used for high power operation such as takeoff, climb and cruise; the second fuel supply means is basically for a low power operation such as for idle or for altitude relight.

The combustor assembly of the present invention is the same in all essential respects as the combustor assembly of the copending Faucher, et al, application hereinbefore referred to excepting for the addition of a second fuel supply means for injecting fuel into the combustion zone at low power or for altitude relight. It has been found that all the advantages of Faucher, et al., are retained while greatly improved performance at idle and altitude relight is realized.

For low engine power operation, such as for idle or for altitude relight, a rich mixture of fuel and air is required within the combustion zone; for high engine power operation, such as for takeoff, climb and cruise, a leaner mixture of fuel and air is required. It is sometimes difficult to provide this wide range of fuel mixtures with a single fuel source. It has been found that the addition of a second fuel source which may be operated separately from the first fuel source eliminates this problem. In one embodiment of the present invention, greatly improved performance is obtained when a conventional type of fuel nozzle for spraying fuel directly into the combustion zone is combined with a premix fuel source which injects fuel into a premixing passage to atomize the fuel with high velocity air flowing within the passage before the mixture is directed through a perforated baffle into the combustion zone. The premixing passage fuel source is turned off at idle and is cut in as power is increased; the conventional fuel nozzles are turned on at idle or for altitude relight and are turned down to a very low fuel flow or to no fuel flow at all at takeoff, climb and cruise. During a transitional phase between low and high power operation the first and second fuel supply means operate in combination. The fuel-air ratio of the mixture passing through the baffle during the transitional phase is very low. Consequently, insufficient energy is produced from the premixed fuel in the combustion zone to maintain the ignition temperature of the fuel. Operation of the second fuel supply means during this condition produces adequate energy release in the vicinity of the baffle means to support continued combustion of the premixed fuel thereby stabilizing the flame. Thus, during takeoff, climb, and cruise the main source of fuel is through the premixing passage, at idle the main source of fuel is through the conventional fuel nozzles, and during the transitional phase tandem operation stabilizes the flame in the vicinity of the baffle means.

It is undesirable to spray large quantities of fuel directly into the combustion chamber through conventional fuel nozzles over the entire engine operating regime since additional combustion chamber length and a large recirculation zone would be required to thoroughly mix the fuel and air within the combustion chamber during the burning process. The construction of the present invention uses conventional fuel supply means only at idle or for altitude relight. At other times fuel is supplied to the combustion zone through the premixing passage and its associated baffle causing a uniform fuel-air mixture to travel substantially radially from one side of the combustion zone to the other side of the combustion zone; there is no dependence on the establishment of a large recirculation zone in the combustion zone to assure a proper mixture of fuel and air for efficient burning since the fuel and air is mixed prior to entering the combustion chamber.

The foregoing and other objects, features and advantages of the present invention will become more apparent in the light of the following detailed description of the preferred embodiment thereof as illustrated in the accompanying drawing.

DESCRIPTION OF THE PREFERRED EMBODIMENT

Figures 1, 4:
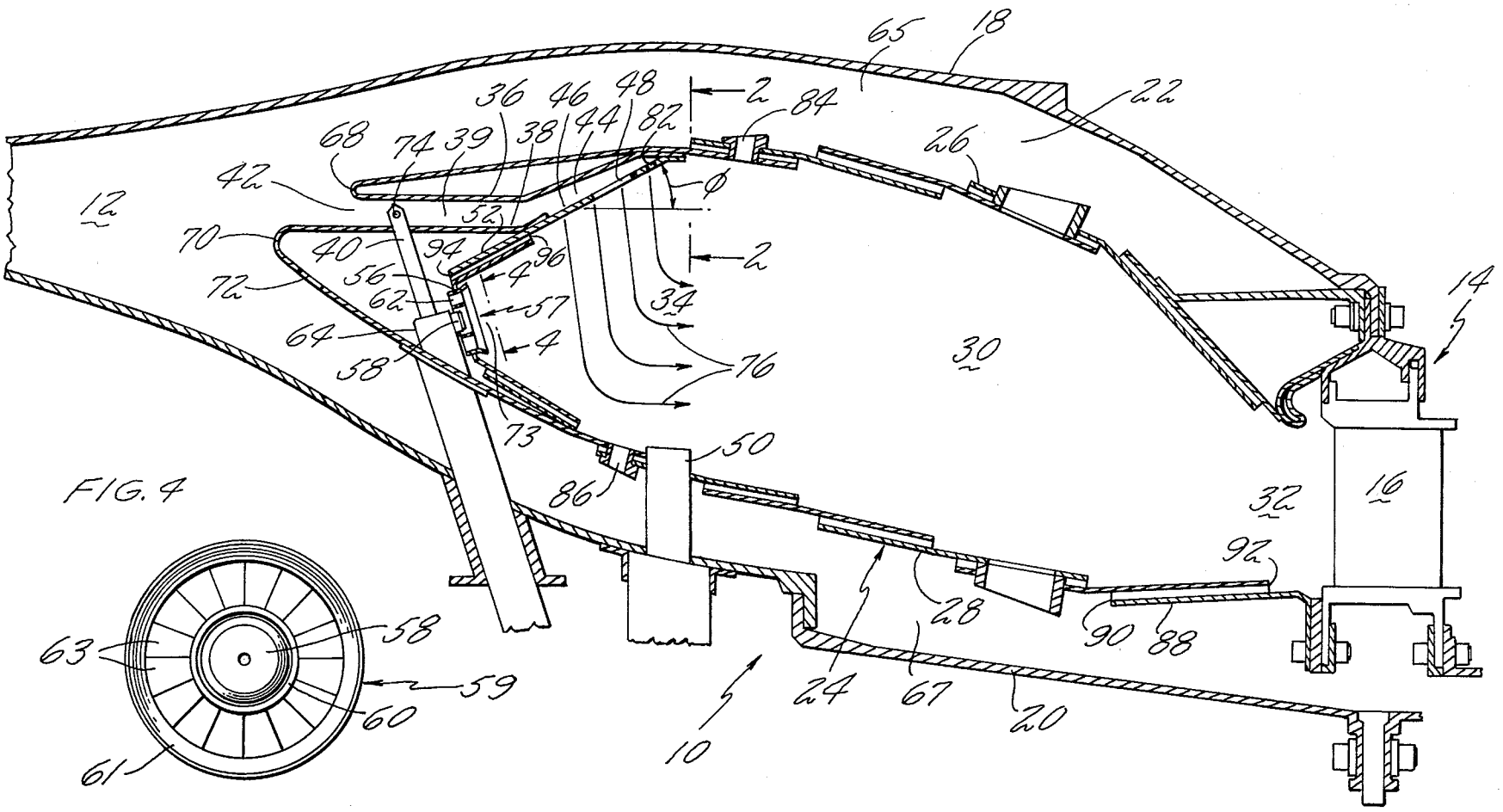
FIG. 1 is an elvation cross sectional view of the combustor section of a gas turbine engine incorporating the present invention.
FIG. 4 is a cross sectional view taken along the line 4—4 of FIG. 1.

As an example of a combustor assembly incorporating the features of the present invention, consider the combustor assembly of FIG. 1 generally represented by the numeral 10. The combustor assembly 10 is situated downstream of a diffuser section 12 (only a portion of which is shown) and upstream of a turbine section 14; only the inlet guide vane 16 of the turbine section 14 is shown.

The combustion assembly 10 includes an inner annular casing 18 and an outer annular casing 20 forming an annular space 22 therebetween. Disposed within the annular space 22 is an annular combustion chamber generally represented by the numeral 24. The combustion chamber 24 includes an inner annular wall 26 and an outer annular wall 28 defining an annulus 30 therebetween. The walls 26, 28 also form an annular outlet 32 at the downstream end of the combustion chamber 24 for directing combustion products into the turbine section 14. The upstream portion 34 of the annulus 30 is the combustion zone. Mounted on the outer annular casing 20 and extending into the primary combustion zone 34 are a plurality of circumferentially spaced ignition means 50 which are shown herein to be conventional spark igniters. The ignition means 50 is mounted in the outer annular casing 20 for ease of removal, but for the purposes of the present invention they could be positioned adjacent the inner annular wall 26 if desired.

According to the present invention, inner annular duct means 36 and outer annular duct means 38 are disposed within the annular space 22 and are spaced apart from each other forming an annular premixing passage 39. In this embodiment the duct means 36, 38 are made of sheet metal and are attached at their downstream ends to the inner annular wall 26 of the combustion chamber 24.

The premixing passage 39 includes an annular inlet 42 and an annular outlet 44, the outlet 44 being in gas communication with the combustion zone 34 of the chamber 24. In this embodiment the inner annular wall 26 includes a baffle 46. The baffle 46 is disposed across the outlet 44 of the premixing passage 39. Also, in this embodiment the baffle is frusto-conical in shape and tapers radially inwardly from an upstream to downstream direction, its upstream and downstream ends being attached by suitable means to the inner annular wall 26 of the combustion chamber 24. The baffle 46 has a plurality of openings 48 therethrough, best shown in FIG. 2. Mounted on the outer annular casing 20 and extending into the premixing passage 39 are a plurality of circumferentially spaced fuel injectors 40, for supplying fuel to the premixing passage 39.

The walls 26, 28 form a partially closed upstream portion 52 of the combustion chamber 24. The upstream portion 52 includes a plurality of openings 56 therethrough, circumferentially spaced about the engine axis. Disposed adjacent each opening 56 is a second fuel source 57. Each fuel source 57 includes a fuel injector, herein shown as a fuel nozzle 58 surrounded by a swirl vane assembly 59. The swirl vane assembly 59 includes inner and outer shrouds 60, 61, respectively, forming an annular passageway 62 around the fuel nozzle 58 for directing air around each nozzle and into the combustion zone 34. Disposed within the passageway 62 and attached to the shrouds 60, 61 are a plurality of circumferentially spaced swirl vanes 63 for swirling the air as it enters the combustion zone 34. In this embodiment, there are forty fuel injectors 40 and forty fuel nozzles 58, each fuel injector 40 has a corresponding fuel nozzle 58 positioned at similar angular locations about the engine axis. As shown in FIG. 1, a fuel injector 40 and a corresponding fuel nozzle 58 are enclosed within a common sleeve 64 although this is not considered required by the present invention; it is also not required by this invention that there be the same number of fuel injectors as fuel nozzles.

As shown in FIG. 1 the inner annular wall 26 is outwardly spaced from the inner annular casing 18 forming an inner air annulus 65 therebetween, and the outer annular wall 28 is inwardly spaced from the outer annular casing 20 forming an outer air annulus 67 therebetween. The duct means 36, 38 form flow divider means 68, 70, respectively, the flow divider means 68 directing a portion of the air from the compressor into the inner air annulus 65, and the flow divider means 70 directing a portion of the air from the compressor into the outer air annulus 67. A portion of the air entering the outer air annulus 67 enters a plurality of circumferentially spaced holes 72 through the flow divider means 70; this air passes through the swirl vane assembly 59 surrounding the fuel nozzles 58 and enters the combustion zone 34.

Another portion of the air from the compressor is received at high velocity into the premixing passage 39; the size of the premixing passage 39 and the area of the openings 48 through the baffle 46 contribute to controlling the velocity of the air through the passage 39. In this embodiment the velocity of the air in the passage is about 350 feet per second.

When the engine is idling, fuel is supplied to the combustion zone only through the fuel nozzles 58. The fuel nozzles 58 and their associated swirl vane assemblies 59 create localized recirculation or stabilization regions 73 immediately downstream and adjacent the fuel sources 57. These stabilization regions have a very rich mixture of fuel as required for the idle condition. Once ignited by the igniters 50 the regions 73 act as a continuous ignition source for the fuel within the combustion zone 34 during idle.

As engine power is increased, fuel is injected into the premixing passage 39 through the fuel injectors 40; at the same time the fuel flow through the fuel nozzles 58 is turned down. Fuel flow through the nozzles 58 is maintained at least through a transitional phase when the fuel-air ratio of the mixture emanating from the premixing passage is low. The additional energy supplied to the combustion zone by the combusting fuel from the nozzles 58 increases the flame stability in the vicinity of the baffle 46 by maintaining the regional temperature in excess of the fuel ignition temperature. At some point the fuel flow through the fuel nozzles 58 may be turned off completely, although it may be desirable as it is in the preferred embodiment, to maintain a small fuel flow through the fuel nozzles 58 at all times. This continuous small fuel flow may be set such that it is sufficient to provide satisfactory relight conditions at altitude; in other words a sufficiently rich mixture of fuel is provided immediately downstream of the fuel nozzles 58 at all times such that relighting the engine at altitude presents no problem and requires no adjustment of the fuel flow through the fuel nozzles 58. However, at takeoff, climb and cruise the greatest bulk of fuel (i.e. on the order of 90 percent) is supplied through the fuel injectors 40 by way of the premixing passage 39.

In this embodiment forty circumferentially spaced fuel injectors 40 are positioned within the passage 39 to achieve a circumferentially uniform fuel-air mixture at the outlet 44 of the passage 39. One of the advantages of this invention is that low pressure drop fuel injectors may be used since atomization of the fuel is accomplished by the high velocity air rushing past the injectors 40 and not by the action of the fuel injectors themselves, as in the case of the fuel nozzles 58 which inject the fuel into the combustion chamber in a fine spray. In other words, the fuel may be injected into the passage 39 through relatively large holes 74 in the tips of the fuel injectors 40. In this preferred embodiment fuel is squirted from the fuel injectors 40 in a tangential direction (i.e. into and out of the plane of the paper in FIG. 1) through 0.060 inch diameter holes, such as the holes 74, one each on the left and right sides as viewed from an axial direction of each fuel injector 40.

The premix passage 39 and the baffle 46 are designed so as to receive sufficient air into the passage to maintain the proper equivalence ratio of the fuel-air mixture entering the combustion zone 34 for appropriate emission control. Additional quantities of air from the inner and outer air annuli 65, 67 are directed into the combustion zone 34 through a plurality of circumferentially spaced openings 84, 86 through the inner and outer annular walls 26, 28, respectively, and through the swirl vane assemblies 59. Air flowing from the spaced openings 84 and 86 is utilized in the combustion reaction at high power operation when insufficient combustion air is available from the premixing passage. The additional combustion air is provided in this manner rather than through the premixing passage in order to retain stable fuel-air ratios in the vicinity of the baffle during lower power operation. Remaining air within the inner and outer air annuli 65, 67 is used for cooling the walls 26, 28, for secondary air downstream of the combustion zone, for dilution air downstream of the combustion zone, and for cooling the inlet guide vanes 16 of the turbine section 14.

There are several other considerations in the design of the premix passage 39. The total area of the openings 48 through the baffle 46 should be larger than the area of the inlet 42 to the passage 39 so that the fuel-air mixture can exit into the combustion chamber 24 at least as fast as the air entering the premix passage to prevent flashback. The axial length of the passage from the point where the fuel is injected to the point furthest downstream where the fuel leaves the passage through the openings 48 in the baffle 46 must be short enough such that auto-ignition does not occur before the mixture enters the combustion chamber; if there is enough dwell time of the fuel within the passage, and if the temperature and pressure of the fuel-air mixture is high enough, the mixture could ignite spontaneously prior to leaving the passage. In this preferred embodiment, bleed holes 82 (best shown in FIG. 2) at the downstream end of the baffle 46 assure that fuel is not able to accumulate in the downstream end of the premix passage such that auto-ignition would be more likely to occur. Also, the shape of the passage should be such that eddies are not created within the passageway; eddies might entrain the fuel-air mixture within the passage giving it time to ignite prior to entering the combustion chamber 24; for this reason the passage 39 should have no sharp edges and no sharp turns such that there is separation of the flow at the walls of the passage.

The fuel-air mixture leaves the passage 39 through the openings 48 (best shown in FIG. 2) in the baffle 46; the shape of the baffle 46 and the orientation of the openings 48 direct the fuel-air mixture radially outwardly across the combustion zone 34 toward the outer annular wall 28. The velocity of the flow through the openings 48 is sufficient to propel at least a portion of the fuel-air mixture across the combustion zone to the outer annular wall 28. This fuel-air mixture from the premix passage 39 does not recirculate as in conventional burners and the prior art; rather it immediately begins to travel downstream. The arrows 76 represent the fuel-air mixture and its path of travel as it leaves the premixing passage 39. Whether this fuel-air mixture recirculates in the conventional manner or whether it travels in the manner of the present invention as indicated by the arrows 76 depends in substantial part on the pressure field within the combustion chamber. In the present invention the openings 48 in the baffle 46 and the holes in the combustion chamber walls 26, 28 are positioned and sized to create a pressure field which compels the fuel-air mixture to travel in the direction of the arrows 76 rather than to recirculate.

The fact that the combusting fuel-air mixture does not, to any significant extent, recirculate within the combustion zone (except for the localized recirculation adjacent the surface of the baffle and also the localized recirculation adjacent the fuel sources 57 when these are operating) reduces the time that the combusting fuel-air mixture remains within this very hot zone. It is known that the very high temperatures within the combustion zone contribute to the formation of oxides of nitrogen; and the longer the combusting fuel-air mixture remains within this very hot zone the greater the amount of oxides of nitrogen produced. The length of the very hot zone in the preferred embodiment of the present invention is limited to the vicinity of the baffle by the introduction of combustion and dilution air from an inner annulus 22 through circumferentially spaced openings 84 in the inner annular wall 26 and from an outer annulus 67 through circumferentially spaced openings 86 in the outer annular wall 28. Although the air flowing through the spaced opening of the inner and outer walls travels in an initially radial direction, it is deflected axially downstream by the combustable gases flowing from the baffle 46 thereby preventing major upstream recirculation of gases within the combustion chamber. Thus, one very important feature of this invention is a reduction in the amount of oxides of nitrogen in the exhaust gases of a gas turbine engine.

Since it is important that the baffle 46 and the openings 48 therethrough direct the fuel-air mixture radially across the combustion zone, they must be designed to impart a velocity to the fuel-air mixture having a substantial radial component. The cone angle $\phi$ of the baffle is important in this regard; if the cone angle is too large the fuel-air mixture might be injected in a substantially axial direction adjacent the inner annular wall 26 of the combustion chamber. There are two basic reasons why this is undesirable. First, it may be difficult to ignite the fuel-air mixture since the igniters 50 are positioned along the outer annular wall 28; second most of the burning would occur adjacent the inner wall 26 resulting in an uneven temperature distribution across the turbine inlet guide vanes 16. The cone angle $\phi$ of the frusto-conical baffle in the embodiment shown in FIG. 1 is approximately 25 degrees.

Although the premix passage 39 in this embodiment is shown being adjacent the inner annular wall 26, it is also contemplated that a combustor assembly may be designed having the premix passage adjacent the outer annular wall of the combustion chamber. In that case the shape of the baffle and the openings through the baffle would be designed to direct the fuel-air mixture radially inwardly across the combustion zone toward the inner annular wall of the combustion chamber. In that instance the baffle would slope radially outwardly from an upstream to downstream direction. In either case, the pressure within the premix passage 39 is higher than the pressure within the combustion zone 34; thus a frusto-conical baffle positioned adjacent the inner annular wall 26, as shown in FIG. 1, would be put in hoop stress, while a baffle positioned adjacent the outer annular wall 28 would be put in compression. Since a frusto-conical shape is better able to withstand a hoop stress rather than a buckling load, it is preferable that the baffle and thus the premix passage be positioned adjacent the inner annular wall.

Figure 2:
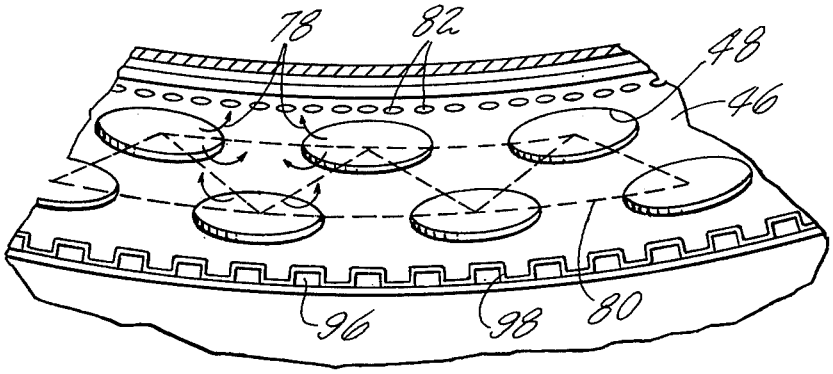
FIG. 2 is a partial cross-sectional view taken along the line 2—2 of FIG. 1.

Referring to FIG. 2, as the fuel-air mixture passes through the openings 48 small local eddies are created in the immediate vicinity of the openings and adjacent the surface of the baffle 46 as generally represented by the arrows 78; in this embodiment the openings 48 are circular and are disposed in two axially spaced rows, each row having a similar number of holes except that the openings 48 in one row are staggered with respect to the openings 48 in the other row such that a triangular pattern represented by the dashed lines 80 is formed. As a result of the eddies 78, a stagnation region is created adjacent each triangular portion of the baffle 46. This region of stagnant combusting fuel-air mixture provides a continuous ignition source for the fuel-air mixture within the combustion zone 34. Once this region of fuel-air mixture is ignited by the spark igniters 50, it is able to remain lit due to the very low velocities of the fuel and air within the region.

In this embodiment the walls 26, 28 of the combustion chamber 24 are constructed of double walled segments having axial cooling air carrying passageways between the walls. With reference, for example, to a downstream segment 88 of the outer wall 28, cooling air enters the upstream end 90 of the segment 88, passes between the double walls of the segment, and exits from between the double walls at the downstream end 92 of the segment 88. This construction is known by the registered trademark FINWALL ®. As can be seen from the drawing, these segments serve to cool the walls 26, 28 of the combustion chamber 24. The upstream portion 52 of the inner wall 26 is also a FINWALL construction. Air enters the upstream end 94 and exits from the downstream end 96 of the portion 52, flowing over the face of the baffle 46 and cooling the same. In FIG. 2 the internal structural element of these FINWALL segments can be seen and is indicated by the numeral 98.

Figure 3:
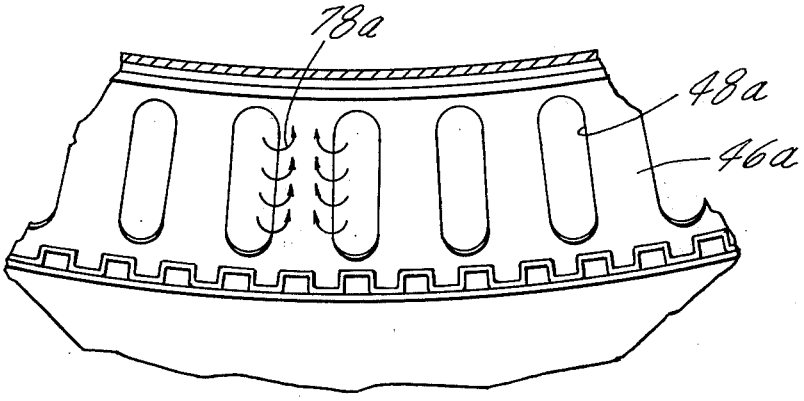
FIG. 3 is a partial cross-sectional view also taken along the line 2—2 of FIG. 1, but showing an alternate construction.

FIG. 3 shows an alternate construction of the baffle 46. In this construction the baffle is designated by numeral **46*a*. Rather than circular openings 48, the baffle 46*a* is provided with a plurality of axially extending and circumferentially spaced slots 48*a*. As the fuel-air mixture passes through the slots 48*a* local eddies are created in the immediate vicinity of the slots and adjacent the surface of the baffle 46*a* as generally represented by the arrows 78*a*. As a result of the eddies 78*a*, a stagnation region is created adjacent the surface of the baffle 46*a* between adjacent slots. This stagnation region acts in a manner similar to the stagnation regions in the embodiment of FIG. 2**. Although the pattern and the shape of the openings through the baffle are shown herein as being either slots or circular holes, the precise shape and placement of these openings is not critical to the present invention. The most important consideration is the ratio of the open area of the baffle to the closed area of the baffle. The ideal percent of open area through the baffle varies with engine design and would depend mainly on the pressure drop across the baffle, the desired velocity of the air in the premix passage, and the temperature rise desired frpom the exit of the compressor to the inlet of the turbine. For most engine applications the open area would be within the range of 30 to 50 percent of the total area of the baffle.

It has been determined in tests of combustor assemblies constructed according to the present invention that not only is performance improved at engine idle and at altitude relight, as has been previously discussed in the summary of the invention, but also, the volume of the combustion chamber required for complete burning of the fuel is 50 percent less than the volume required in combustion systems using conventional fuel supplying devices for all operating conditions. This is due to the better mixing of the fuel and air within the combustion zone and the more even distribution of the fuel and air over the entire radius and circumference of the combustor volume. It has also been determined that there is a 50 percent reduction in the amount of oxides of nitrogen in the exhaust gases as compared to conventional burners; furthermore, this type of burner has low smoke emissions and has shown a significant reduction in unburned hydrocarbons.

In this preferred embodiment the second fuel sources 57 are shown as comprising swirl vane assemblies 59 and fuel nozzles 58 for spraying fuel directly into the primary combustion zone 34; however, it is contemplated by this invention that each second fuel source may be of the premixing type, wherein the passageway surrounding each fuel nozzle is a premixing passageway and the fuel nozzle injects fuel into the premixing passageway; the fuel would be atomized by high velocity air passing through the passageway, and the air and fuel mixture might pass into the combustion zone through a perforated baffle positioned at the outlet end of the passageway. In other words, the individual fuel sources 57 could be a plurality of circumferentially spaced individual premixing type of fuel sources, each working in a manner similar to the full annular premixing passage 39, but being used only for low power engine operation.

Although the invention has been shown and described with respect to preferred embodiments thereof, it should be understood by those skilled in the art that various changes and omissions in the form and detail thereof may be made therein without departing from the spirit and the scope of the invention.

We claim:

1. An improved annular combustor for a turbine type power plant having an inner casing and outer casing defining an annular chamber, liner means closed at the forward end and opened at the rearward end which end is directly communicating with the turbine of the power plant disposed in said annular chamber defining a combustion zone, a premix passage formed adjacent the closed end of said liner by said liner and an annular wall surrounding said liner, a baffle at the downstream end of said premix passage having openings whose axis is at an angle relative to the axis of the combustion zone interconnecting said passage with said combustion zone so as to discharge a fuel/air mixture into the combustion zone in a forward to rearward direction with radial component creating local eddies on the downstream side of said openings without incurring large recirculating zones, at least one secondary fuel nozzle in said premix passage for admitting fuel upstream of said baffle when said power plant is operating at high power, at least one primary fuel nozzle operable independently of said secondary fuel nozzle disposed in proximity to the closed end of said liner for admitting fuel in the combustion zone forwardly and radially of the openings in said baffle when said power plant is operating at low power and said secondary nozzle being disposed forwardly and radially relative to said primary nozzle.

2. An improved annular combustor as claimed in claim 1 wherein said annular wall has a forward end extending in the discharge airstream of the compressor and forming a splitter for a portion of compressor air to be admitted into said premix passage and defining an inlet thereto, and said nozzle in said premix passage being located downstream of said inlet and spaced from said baffle sufficient distance to achieve maximum residence time of the injected fuel without incurring autoignition.

3. The invention according to claim 2 wherein said primary nozzle is mounted on said liner for injecting fuel directly into the combustion zone and wherein said primary nozzle is a nozzle of the pressure atomizing type.

4. The invention according to claim 3 wherein said primary nozzle is surrounded by a plurality of swirl vanes which flow a portion of the combustion air from the compressor into the combustion zone.

5. Means for reducing the pollutants emitted from an axial flow gas turbine engine, which engine includes a combustor, a compressor forward of said combustor and a turbine rearward of said combustor, said means comprising:

means disposed in said combustor for burning fuel including a first wall means closed at one end defining an annular combustion chamber around the axis of said engine having a combustion zone at the upstream end thereof, said first wall means opened at an opposite end forming an outlet at the downstream end of said chamber for directing combustion products into the turbine;

second wall means surrounding a portion of the first wall means and radially spaced therefrom forming an annular premixing passage having an inlet and an outlet and said premixing passage being wholly forward of said passage outlet for receiving air being discharged from the compressor;

fuel supply means disposed within said premixing passage for introducing fuel into said premixing passage, the flow of air within said premixing passage atomizing the fuel within the premixing passage, said premixing passage being in gas communication with said combustion zone, baffle means having apertures formed therein disposed across said outlet of said premixing passage for directing the fuel-air mixture from said premixing passage radially across said primary combustion zone toward said other wall of said chamber, said baffle means including a downstream facing surface creating localized eddies within said combustion zone immediately adjacent said downstream facing surface of said baffle means between adjacent openings, and said localized eddies defining stabilization regions for continuous ignition for said combustion zone, at least one secondary fuel nozzle in said premix passage for admitting fuel upstream of said baffle when said power plant is operating at high power, at least one primary fuel nozzle operable independently of said secondary fuel nozzle disposed in proximity to the closed end of said first wall means for admitting fuel in the combustion zone forwardly and radially of the openings in said baffle when said power plant is operating at low power and said secondary nozzle being disposed forwardly and radially relative to said primary nozzle.

6. Means as defined in claim 5 including an outer casing surrounding and spaced from said first wall means defining therewith an annular passage having an inlet receiving air flow from said compressor, circumferentially spaced holes axially spaced in said first wall means for admitting combustion air and dilution air into said combustion chamber, said circumferentially spaced holes having a predetermined area ratio to the area of said apertures for creating a predetermined pressure field whereby said fuel-air mixture flows substantially in an axial direction from upstream to downstream in said combustion chamber so as to avoid relatively large recirculation zones.

7. Means as defined in claim 6 wherein said apertures are spaced ahead of said combustor air and dilution air holes with respect to said turbine.

8. Means as defined in claim 6 wherein said wall means includes an inner and outer wall, said inner wall being closer to said engine axis, said baffle means being disposed adjacent to said inner wall and forming apart thereof to define a substantially front facing portion of said combustion chamber.

9. Means as defined in claim 8 wherein said baffle means is generally frusto-conical in shape, sloping radially inwardly from an upstream to downstream direction with respect to the flow of said fuel-air mixture.

10. Means as defined in claim 6 wherein the combined area of said apertures constitutes substantially 30–50% of the entire area of said baffle.

11. Means as defined in claim 10 wherein the area of said inlet of said premixing passage is less than the combined area of said apertures of said baffle.

12. Means as defined in claim 9 wherein the base of said frusto-conically shaped baffle is located at its downstream end relative to the flow in said combustion chamber and that the angle at said base and the axis of said engine is substantially 25 degrees.

* * * * *